US005285665A

United States Patent [19]

Hetrick, Jr.

[11] Patent Number: 5,285,665

[45] Date of Patent: Feb. 15, 1994

[54] WASHING MACHINE WATER RECYCLING APPARATUS

[76] Inventor: Carl L. Hetrick, Jr., R.D. #1, Box 303A, Berlin, Pa. 15530

[21] Appl. No.: 993,364

[22] Filed: Dec. 18, 1992

[51] Int. Cl.[5] ..... D06F 39/08; D06F 39/10

[52] U.S. Cl. ..... 68/18 F; 68/207; 68/208; 68/209; 68/902; 137/571; 137/625.44; 220/371; 422/123

[58] Field of Search ..... 68/902, 18 R, 18 F, 68/207, 208, 209; 137/571, 625.44, 875; 220/371, 372, 908; 454/3, 35; 422/123

[56] References Cited

U.S. PATENT DOCUMENTS

| | | | |
|---|---|---|---|
| 2,931,199 | 4/1960 | Steffey | 137/571 X |
| 2,931,200 | 4/1960 | Schell et al. | 137/571 X |
| 4,149,564 | 4/1979 | Higby et al. | 137/625.44 |
| 4,160,367 | 7/1979 | Vona, Jr. | 68/207 X |
| 4,495,960 | 1/1985 | Cartier et al. | 68/902 X |

FOREIGN PATENT DOCUMENTS

| | | | |
|---|---|---|---|
| 547609 | 4/1932 | Fed. Rep. of Germany | 137/875 |
| 2910140 | 9/1980 | Fed. Rep. of Germany | 68/902 |

*Primary Examiner*—Philip R. Coe
*Attorney, Agent, or Firm*—Leon Gilden

[57] ABSTRACT

A washing machine is arranged to reuse and accordingly recycle rinse water for a laundry procedure, wherein a plurality of solenoids are operative and in cooperative relationship relative to one another to arrange for initial directing of rinse water into a recycling tank and subsequently directing the rinse water from the recycling tank back to the washing machine tub permitting subsequent drainage of the rinse water subsequent to its reuse.

2 Claims, 4 Drawing Sheets

WASHING MACHINE WATER RECYCLING APPARATUS

BACKGROUND OF THE INVENTION

1. Field of the Invention

The field of invention relates to washing machine apparatus, and more particularly pertains to a new and improved washing machine water recycling apparatus wherein the same is arranged to recycle and filter washing machine rinse water.

2. Description of the Prior Art

Apparatus in washing machines to permit the reclamation as well as recycling of water is indicated in U.S. Pat. Nos. 3,570,272; 4,953,369; 5,004,536; and 3,514,631. U.S. Pat. No. 4,835,994 indicates a prior washing machine structure utilizing a fixed drum and drive motor and the like of substantially conventional construction.

The instant invention attempts to overcome deficiencies of the prior art by providing for a holding tank mounted in adjacency to and in surrounding relationship relative to the wash machine tub to permit temporary storage of rinse water or reuse and in this respect, the present invention substantially fulfills this need.

SUMMARY OF THE INVENTION

In view of the foregoing disadvantages inherent in the known types of washing machine apparatus now present in the prior art, the present invention provides a washing machine water recycling apparatus wherein the same is arranged to recycle rinse water in a subsequent washing procedure. As such, the general purpose of the present invention, which will be described subsequently in greater detail, is to provide a new and improved washing machine water recycling apparatus which has all the advantages of the prior art washing machine apparatus and none of the disadvantages.

To attain this, the present invention provides a washing machine arranged to reuse and accordingly recycle rinse water for a laundry procedure, wherein a plurality of solenoids are operative and in cooperative relationship relative to one another to arrange for initial directing of rinse water into a recycling tank and subsequently directing the rinse water from the recycling tank back to the washing machine tube permitting subsequent drainage of the rinse water subsequent to its reuse.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved washing machine water recycling apparatus which has all the advantages of the prior art washing machine apparatus and none of the disadvantages.

It is another object of the present invention to provide a new and improved washing machine water recycling apparatus which may be easily and efficiently manufactured and marketed.

It is a further object of the present invention to provide a new and improved washing machine water recycling apparatus which is of a durable and reliable construction.

An even further object of the present invention is to provide a new and improved washing machine water recycling apparatus which is susceptible of a low cost of manufacture with regard to both materials and labor, and which accordingly is then susceptible of low prices of sale to the consuming public, thereby making such washing machine water recycling apparatus economically available to the buying public.

Still yet another object of the present invention is to provide a new and improved washing machine water recycling apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
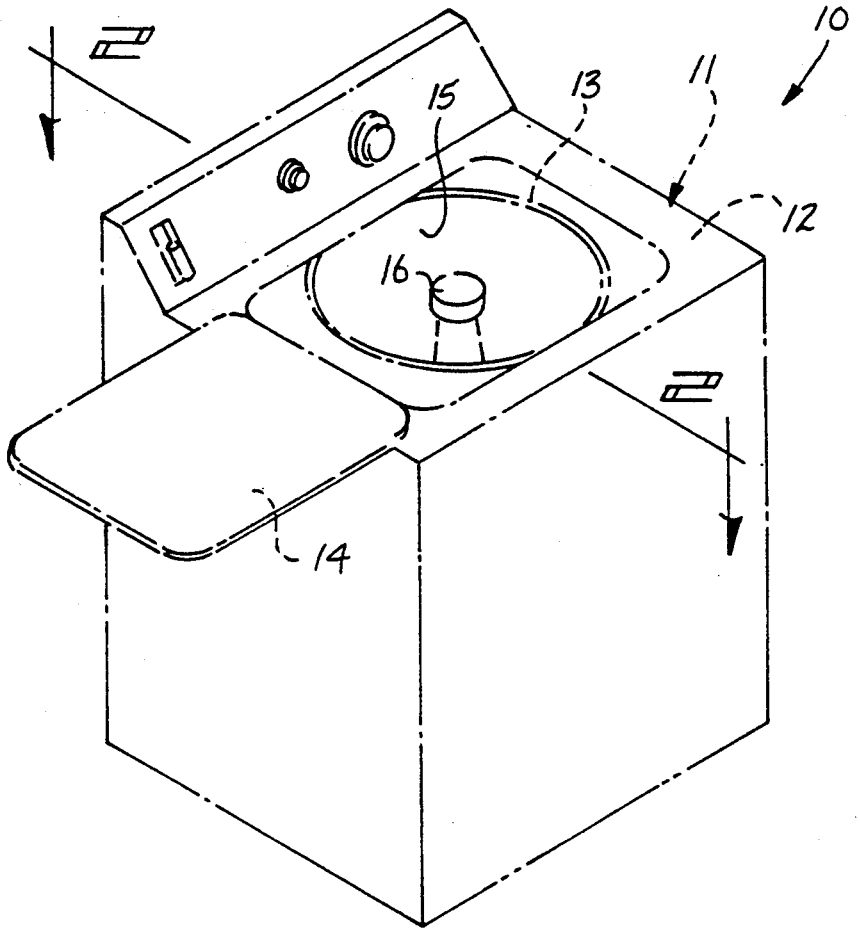
FIG. 1 is an isometric illustration of the invention.
Figure 2:
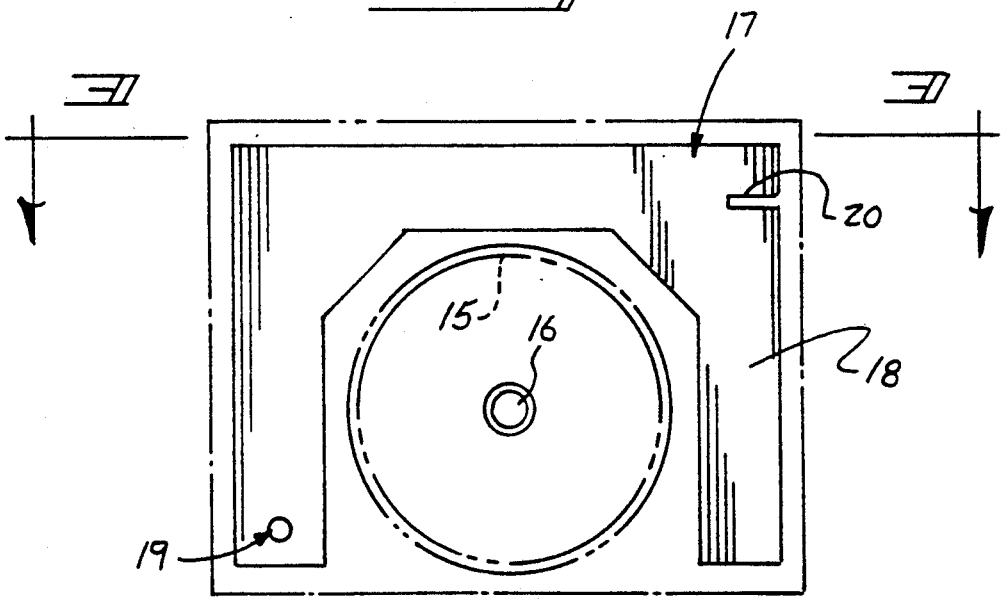
FIG. 2 is an orthographic view, taken along the lines 2—2 of FIG. 1 in the direction indicated by the arrows.
Figure 3:
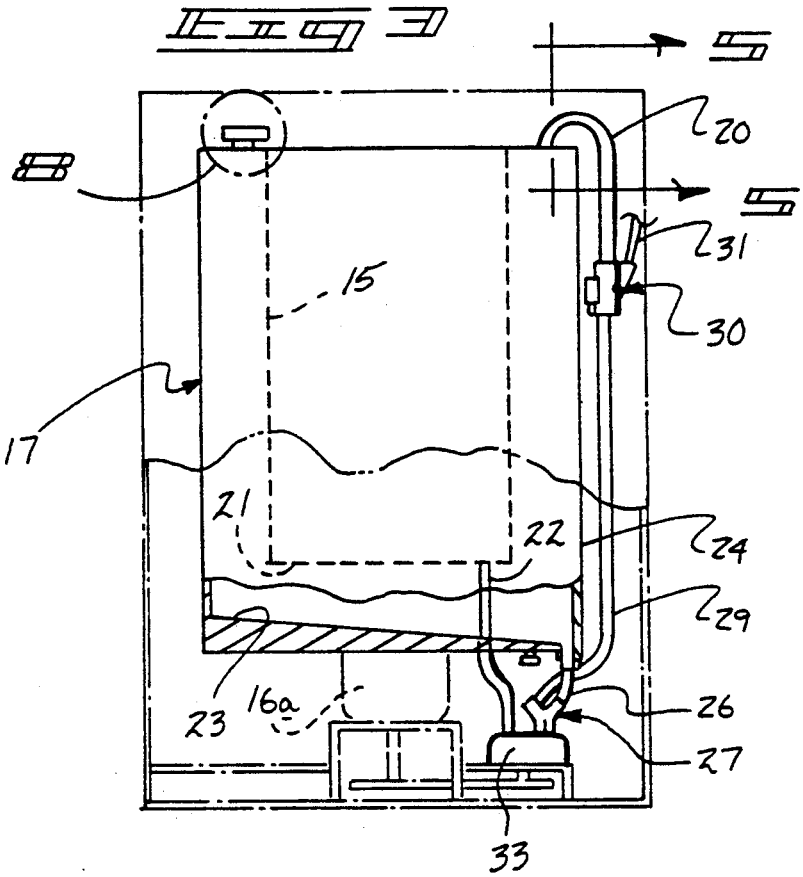
FIG. 3 is an orthographic view, taken along the lines 3—3 of FIG. 2 in the direction indicated by the arrows.

With reference now to the drawings, and in particular to FIGS. 1 to 9 thereof, a new and improved washing machine water recycling apparatus embodying the principles and concepts of the present invention and generally designated by the reference numeral 10 will be described.

Figure 4:
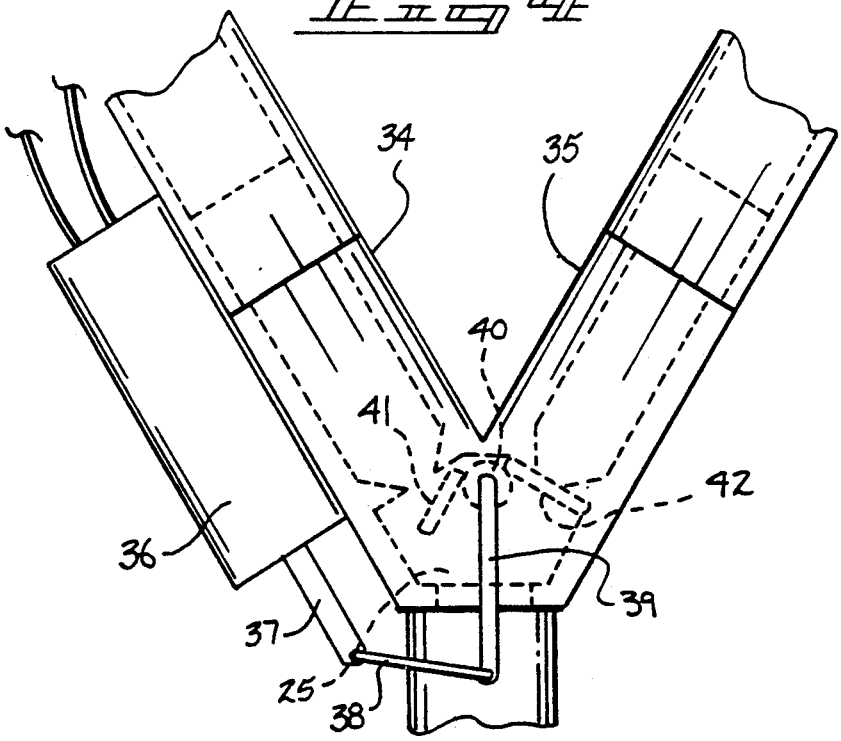
FIG. 4 is an orthographic view of a solenoid valve construction as employed by the invention.

More specifically, the washing machine water recycling apparatus 10 of the instant invention essentially comprises a washing machine housing 11, having a housing top wall 12, with a top wall opening 13, to include a lid 14 pivotally mounted to the top wall for access through the opening 13. A washing machine tub 15 is mounted within the housing 11, including an agitator member 16 and an agitator member drive motor 16*a* of conventional construction, as exemplified in U.S. Pat. No. 4,835,994 incorporated herein by reference, utilizing typical washing cycles. The invention includes a recycling tank 17 mounted within the housing arranged around and in adjacency to the tub 15, with the recycling tank 17 having a tank top wall 18, with the top wall 18 having a vent 19 and a fill conduit 20 directed into the recycling tank 17 through the top wall 18. The tub 15 includes a tub bottom wall 21, having a tub drain conduit 22 directed therefrom extending and directed in fluid communication between the washing machine tub 15 and a reversible pump 33. The recycling tank 17 as indicated is arranged to include a recycling tank side wall 24 and a recycling tank canted bottom wall 23, having a sloped surface directed downwardly towards a recycling tank drain conduit 26, that in turn is in fluid communication with a first solenoid valve 27. The fill conduit 20 is in fluid communication with a second solenoid valve 30 that in turn includes a delivery conduit 29 between the second solenoid valve 30 and the first solenoid valve 27. Each of the first and second solenoids 27 and 30 is constructed as indicated in FIG. 4 to have a solenoid first tube 34 and a solenoid second tube 35 converging into a solenoid chamber 25. Within the solenoid chamber 25 are respective first and second gate members 41 and 42 fixedly mounted to an actuator shaft 40 that is positioned at the intersection of the first and second tubes 34 and 35. A solenoid member 36 mounted to each of the solenoids includes a solenoid rod 37 reciprocatably mounted to each solenoid member 36, with a first link 38 mounted to the solenoid rod 37 at a spaced relationship relative to the solenoid member 36. The link 38 in turn is pivotally mounted to a solenoid second link 39, that in turn is fixedly and orthogonally mounted to the actuator shaft 40 to effect rotation of the actuator shaft upon pivoting of the solenoid second link 39 by displacing the first link 38, in turn by the solenoid rod 37. The second solenoid, as indicated accordingly, includes the second solenoid second tube 35 in fluid communication with a drain conduit 31, and the second solenoid first tube in fluid communication with the fill conduit 20. Directed into the solenoid chamber 25 is the delivery conduit 29, that in turn is in fluid communication from the second solenoid chamber to the first solenoid first tube, with the first solenoid having a first solenoid second tube in fluid communication with the recycling tank drain conduit 26.

In this manner, subsequent to a rinse cycle in the tub 15, water is directed through the drain conduit 22 into the pump 33 that directs water into the first solenoid 27 and into the first solenoid first solenoid tube 34 that is in fluid communication with the delivery conduit 29. The delivery conduit 29 directs water to the second solenoid 30 and to the second solenoid first solenoid tube 34, that in turn is in fluid communication with the fill conduit 20 directing the water into the recycling tank 17. To reutilize this water within the recycling tank, upon timed sequencing of a desired timer mechanism (not shown), the first solenoid 27 opens the first solenoid second tube directing fluid into the reversible pump 33 that in turn directs the fluid through the drain conduit 22 into the tub 15. To complete drainage subsequent to the washing cycle, the first solenoid 27 directs fluid to the delivery conduit 29, but the second solenoid 30 effects closing of the second solenoid first tube 34 to direct fluid to the second solenoid second tube 35 into an associated drain tube 31.

Figure 5:
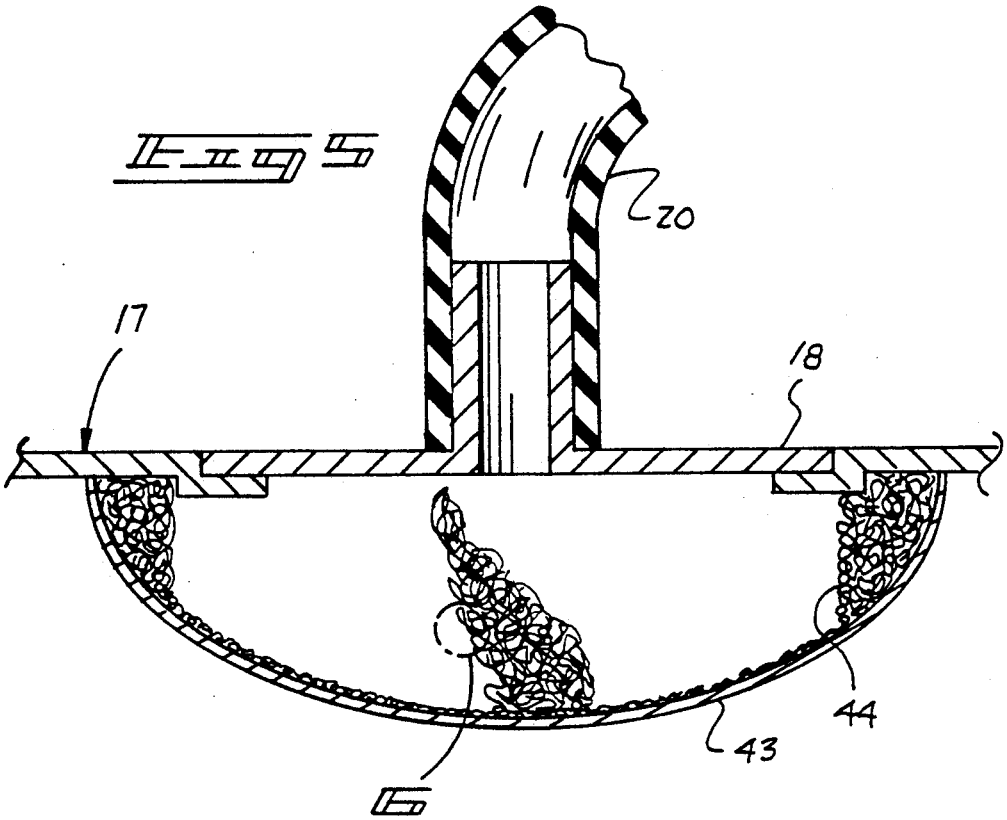
FIG. 5 is an orthographic view, taken along the lines 5—5 of FIG. 3 in the direction indicated by the arrows.
Figure 6:
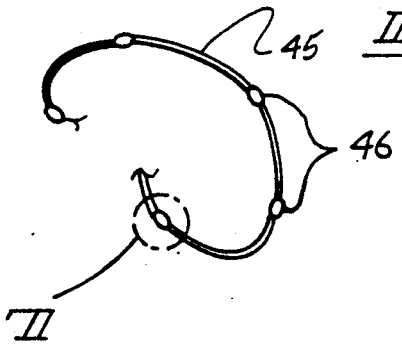
FIG. 6 is an isometric illustration of a typical filter strand, as indicated in section 6 of FIG. 5.
Figure 7:
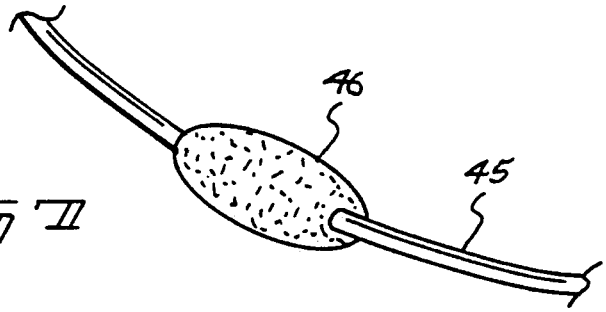
FIG. 7 is an enlarged isometric illustration of section 7 as set forth in FIG. 6.

The FIG. 5 indicates the fill conduit 20 directed into the recycling tank 17 through the recycling tank top wall 18, wherein a porous filter housing 43 is mounted within the recycling tank in surrounding relationship to the entrance of the fill conduit through the top wall 18. The porous filter housing 43 includes filter webbing 44 therewithin formed of various filter webbing strands 45. Each of the filter webbing strands 45 includes a water soluble disinfectant member 46. Replenishment of the filter webbing 44 thereby permits replenishment of the disinfectant members 46 and their use in the treating of the water directed into the recycling tank 17.

Figure 8:
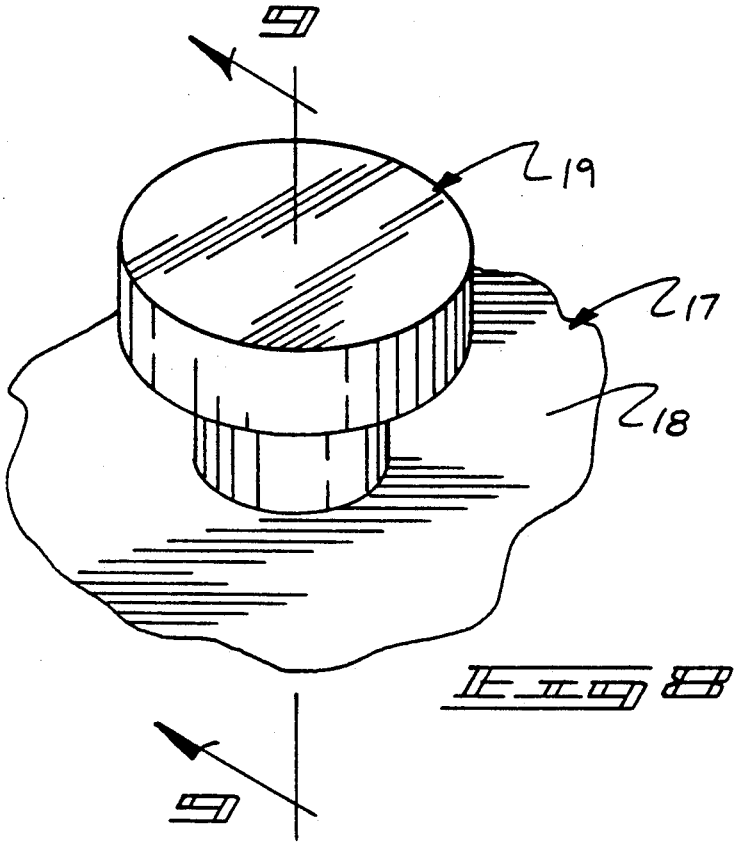
FIG. 8 is an isometric illustration of section 8 as set forth in FIG. 3.
Figure 9:
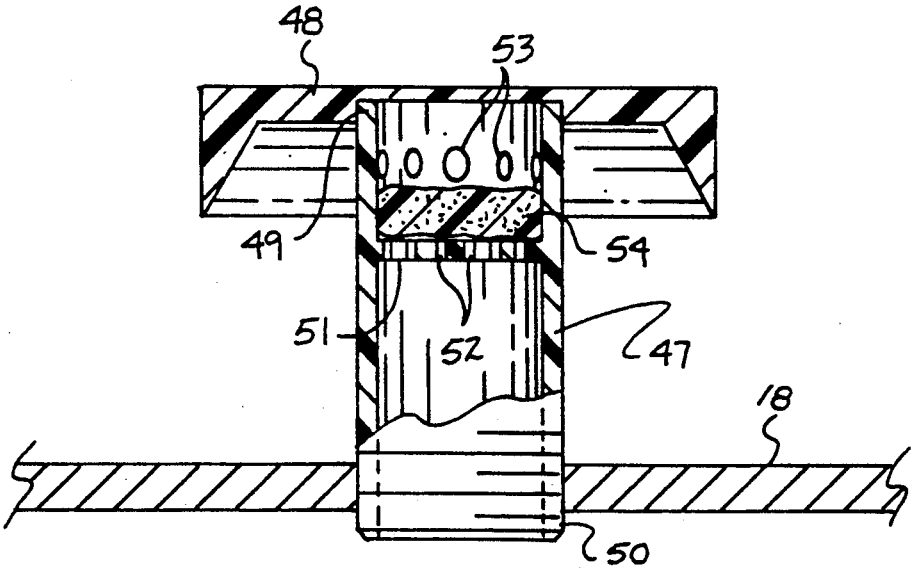
FIG. 9 is an orthographic view, taken along the lines 9—9 of FIG. 8 in the direction indicated by the arrows.

The FIGS. 8 and 9 indicate the tank vent 19 and its construction having a vent tube 47, including a tube first end 49 spaced above the tank top wall 18, with the vent tube second end 50 directed into the recycling tank 17 below the tank top wall 18. A tube cap 48 is mounted to the tube first end 49 and extending laterally therebeyond, with a vent tube intermediate wall 51 positioned within the vent tube intermediate the first and second ends 49 and 50. The intermediate web 51 includes a plurality of intermediate web apertures 52, with a fragrance saturated porous sponge 54 mounted within the vent tube between the intermediate web 51 and the tube first end 49. Vent tube wall apertures 53 are directed through the vent tube wall in adjacency to the sponge 54 to direct vented air from within the recycling tank 17 through the sponge 54 and subsequently through the vent tube wall apertures 53.

As to the manner of usage and operation of the instant invention, the same should be apparent from the above disclosure, and accordingly no further discussion relative to the manner of a usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A washing machine water recycling apparatus, comprising, a washing machine housing, having a housing top wall and a top wall opening directed through the housing top wall, with a lid mounted to the top wall for access to the top wall opening, and a washing machine tub mounted within the housing, and a recycling tank mounted within the housing in adjacency to the washing machine tub, the recycling tank having a recycling tank top wall, with a tank vent directed through the tank top wall, and the washing machine tub having a tub floor, with a tub drain conduit directed through the tub floor, and a reversible pump, with the reversible pump in fluid communication with the tub drain conduit, and the recycling tank having a tank floor, with the tank floor including a tank drain conduit directed through the tank floor, and a first solenoid valve in fluid communication with the tank drain conduit, and the first solenoid valve in fluid communication with the reversible pump, and a delivery conduit in fluid communication with the first solenoid valve directed from the first solenoid valve to a second solenoid valve, and the second solenoid valve having a valve drain conduit in fluid communication with the second solenoid valve, and the second solenoid valve further including a fill conduit directed from the second solenoid valve through the tank top wall into the recycling tank, with the delivery conduit in selective communication with the fill conduit and an outlet drain conduit, and the reversible pump in selective communication with the delivery conduit and the tank drain conduit, and the first solenoid valve includes a first solenoid valve first tube and a first solenoid valve second tube, the first solenoid valve first tube in fluid communication with the tank drain conduit, and the first solenoid valve second tube in fluid communication with the delivery conduit, with the first solenoid first tube and the first solenoid valve second tube in fluid communication with a first solenoid valve chamber, and the first solenoid valve chamber in fluid communication with the reversible pump, and the second solenoid valve having a second solenoid valve first tube in fluid communication with the outlet drain conduit, and the second solenoid valve second tube in fluid communication with the fill conduit, with the second solenoid valve first tube and the second solenoid second tube directed into a second solenoid valve chamber within the second solenoid valve, and the second solenoid valve chamber within the second solenoid valve, and the second solenoid valve chamber in fluid communication with the delivery conduit, and the first solenoid valve and the second solenoid valve each includes a solenoid member, and the first solenoid chamber and the second solenoid chamber each include an actuator shaft, each actuator shaft including a first gate and a second gate, with each first gate in fluid communication with one of said first tubes, and each second gate in fluid communication with one of said second tubes, and each actuator shaft having a second link fixedly mounted thereto, and each second link having a first link pivotally mounted to the second link, and each first link including a solenoid rod pivotally mounted to the first link, with each solenoid rod reciprocatably mounted within a solenoid member, and said first solenoid and said second solenoid including said solenoid member, and the vent includes a vent tube directed through the tank top wall, with the vent tube having a first end spaced above the tank top wall, and a tube second end directed into the tank top wall, with the tube first end having a tube cap, and the vent tube including an intermediate web including a plurality of apertures directed therethrough, and a fragrance saturated porous sponge mounted within the vent tube between the intermediate web and the vent tube first end, and the vent tube further including a plurality of vent tube wall apertures directed through the vent tube between the intermediate web and the vent tube first end.

2. An apparatus as set forth in claim 1 including a porous filter housing mounted within the recycling tank in fluid communication with the fill conduit, and the porous filter housing including a filter webbing therewithin, the filter webbing including a plurality of strands, and each strand including a plurality of water soluble disinfectant members mounted to each strand.

* * * * *